US009570889B2

(12) United States Patent
Fujimura et al.

(10) Patent No.: US 9,570,889 B2
(45) Date of Patent: Feb. 14, 2017

(54) SPARK PLUG

(71) Applicant: NGK SPARK PLUG CO., LTD., Nagoya-shi, Aichi (JP)

(72) Inventors: Kengo Fujimura, Ichinomiya (JP); Haruki Yoshida, Tajimi (JP)

(73) Assignee: NGK SPARK PLUG CO., LTD., Nagoya (JP)

( * ) Notice: Subject to any disclaimer, the term of this patent is extended or adjusted under 35 U.S.C. 154(b) by 0 days.

(21) Appl. No.: 15/204,148

(22) Filed: Jul. 7, 2016

(65) Prior Publication Data

US 2017/0018909 A1 Jan. 19, 2017

(30) Foreign Application Priority Data

Jul. 15, 2015 (JP) ..... 2015-141103
Apr. 21, 2016 (JP) ..... 2016-085620

(51) Int. Cl.

| | |
|---|---|
| ***H01T 13/20*** | (2006.01) |
| ***F02P 11/00*** | (2006.01) |
| ***H01T 13/05*** | (2006.01) |
| ***H01T 13/08*** | (2006.01) |
| ***H01T 13/58*** | (2011.01) |

(52) U.S. Cl.
CPC ..... *H01T 13/20* (2013.01); *F02P 11/00* (2013.01); *H01T 13/05* (2013.01); *H01T 13/08* (2013.01); *H01T 13/58* (2013.01)

(58) Field of Classification Search
CPC ..... H01T 13/20; H01T 21/02
USPC ..... 313/137, 141, 143
See application file for complete search history.

(56) References Cited

U.S. PATENT DOCUMENTS

| | | | |
|---|---|---|---|
| 9,035,541 | B2 | 5/2015 | Yoshida et al. |
| 2001/0007196 | A1 | 7/2001 | Sugimoto et al. |
| 2013/0285534 | A1 | 10/2013 | Ochiai et al. |

FOREIGN PATENT DOCUMENTS

| | | | |
|---|---|---|---|
| EP | 0829936 | A1 | 3/1998 |
| JP | 2013-206740 | A | 10/2013 |

OTHER PUBLICATIONS

European Patent Office, Extended European Search Report issued in corresponding Application No. 16179686.7, mailed Dec. 13, 2016.

*Primary Examiner* — Vip Patel
(74) *Attorney, Agent, or Firm* — Stites & Harbison, PLLC; Jeffrey A. Haeberlin; James R. Hayne

(57) ABSTRACT

A spark plug with an insulator that includes: a first portion having a first inner diameter with a front end of a trunk portion of a metal terminal disposed therein; a second portion having a second inner diameter larger than the first inner diameter, and including a portion 1 mm or more forward of a rear end of the insulator; and a third portion disposed between the first portion and the second portion and having a third inner diameter larger than the first inner diameter and smaller than the second inner diameter. The trunk portion of the metal terminal includes: a front trunk portion and a rear trunk portion with a front end of the rear trunk portion positioned forward of a rear end of the third portion of the insulator, the rear trunk portion having an outer diameter larger than the outer diameter of the front trunk portion.

4 Claims, 7 Drawing Sheets

COMPARATIVE EMBODIMENT

MODIFICATION

MODIFICATION

MODIFICATION

SPARK PLUG

CROSS REFERENCE TO RELATED APPLICATION

The present application claims priority to Japanese Patent Application No. 2015-141103, filed on Jul. 15, 2015, and Japanese Patent Application No. 2016-085620, filed on Apr. 21, 2016, the disclosures of which are herein incorporated by reference.

BACKGROUND OF THE INVENTION

Field of the Invention

The present invention relates to spark plugs used for ignition of fuel gas in internal combustion engines and the like.

Description of Related Art

In a spark plug used for ignition in an internal combustion engine or the like, when a voltage is applied to a center electrode and a ground electrode which are insulated from each other by an insulator, a spark occurs in a spark gap formed between a front end portion of the center electrode and a front end portion of the ground electrode (e.g., Patent Document 1).

RELATED ART DOCUMENT

Patent Document 1 is Japanese Patent Application Laid-Open (kokai) No. 2013-206740.

BRIEF SUMMARY OF THE INVENTION

However, with reduction in diameter and size of a spark plug, an insulator tends to be thinner and the outer diameter of a metal terminal tends to be smaller. As a result, cracking of the insulator tends to occur easily due to vibration or the like of the metal terminal. Therefore, it may become difficult to ensure resistance to cracking of the insulator.

The present specification discloses a technique that is able to improve resistance to cracking of an insulator of a spark plug.

The technique disclosed in the present specification can be embodied in the following application examples.

Application Example 1

A spark plug comprising:

an insulator having an axial bore extending along an axis from a rear end of the insulator toward a front end of the insulator;

a center electrode extending along the axis, and having a rear end located inside the axial bore;

a metal terminal including a trunk portion and a head portion, the trunk portion being located inside the axial bore and having a front end located rearward of the rear end of the center electrode (i.e., at a rear side with respect to the rear end of the center electrode), the head portion being located rearward of the trunk portion (i.e., at the rear side with respect to the trunk portion) and being exposed to the outside at the rear end of the insulator (i.e., the rear side with respect to the insulator); and a conductive seal member that is in contact with the front end of the trunk portion of the metal terminal in the axial bore, wherein the insulator includes:

a cylindrical first portion having a first inner diameter, at which the front end of the trunk portion of the metal terminal is disposed (i.e., the front end of the trunk portion of the metal terminal is disposed within the cylindrical first portion of the axial bore);

a cylindrical second portion having a second inner diameter larger than the first inner diameter, and including a portion (of the insulator) 1 mm or more forward of the rear end of the insulator (i.e., distant from a rear end of the insulator toward the front side); and a cylindrical third portion disposed between the first portion and the second portion, and having a rear end and a third inner diameter larger than the first inner diameter and smaller than the second inner diameter, and wherein the trunk portion of the metal terminal includes:

a cylindrical front trunk portion including a front end, and a cylindrical rear trunk portion located rearward of the front trunk portion (i.e., at the rear side with respect to the front trunk portion), and having an outer diameter larger than an outer diameter of the front trunk portion, and the third portion has a rear end located at the rear side with respect to a front end of the rear trunk portion (i.e., the cylindrical rear trunk portion has a front end positioned forward of the rear end of the cylindrical third portion of the insulator).

According to the above configuration, for example, when the metal terminal vibrates, the trunk portion is more likely to come into contact with the third portion of the insulator which is relatively distant from the rear end of the insulator, and is less likely to come into contact with the second portion of the insulator. As a result, impact applied from the metal terminal to the insulator can be reduced, whereby cracking of the insulator can be suppressed.

Application Example 2

The spark plug according to Application Example 1, wherein the third portion of the insulator has a thickness, in a radial direction, equal to or smaller than 6.1 mm.

According to the above configuration, cracking of the third portion of the insulator having a relatively small thickness in the radial direction can be effectively suppressed.

Application Example 3

The spark plug according to Application Example 1 or 2, wherein the first inner diameter is equal to or smaller than 2.9 mm.

According to the above-configuration, cracking of the insulator can be effectively suppressed although vibration is likely to occur because of the relatively small outer diameter of the trunk portion of the metal terminal.

The present invention can be implemented in various forms. For example, the present invention may be implemented as a spark plug, an insulator for the spark plug, an internal combustion engine equipped with the spark plug, an ignition system using the spark plug, and an internal combustion engine equipped with the ignition system.

BRIEF DESCRIPTION OF THE DRAWINGS

Illustrative aspects of the invention will be described in detail with reference to the following figures wherein.

DETAILED DESCRIPTION OF EXEMPLARY EMBODIMENTS OF THE INVENTION

Embodiments of the present invention will be described in the following order:

A. Embodiment

A-1. Configuration of Spark Plug

Figure 1:
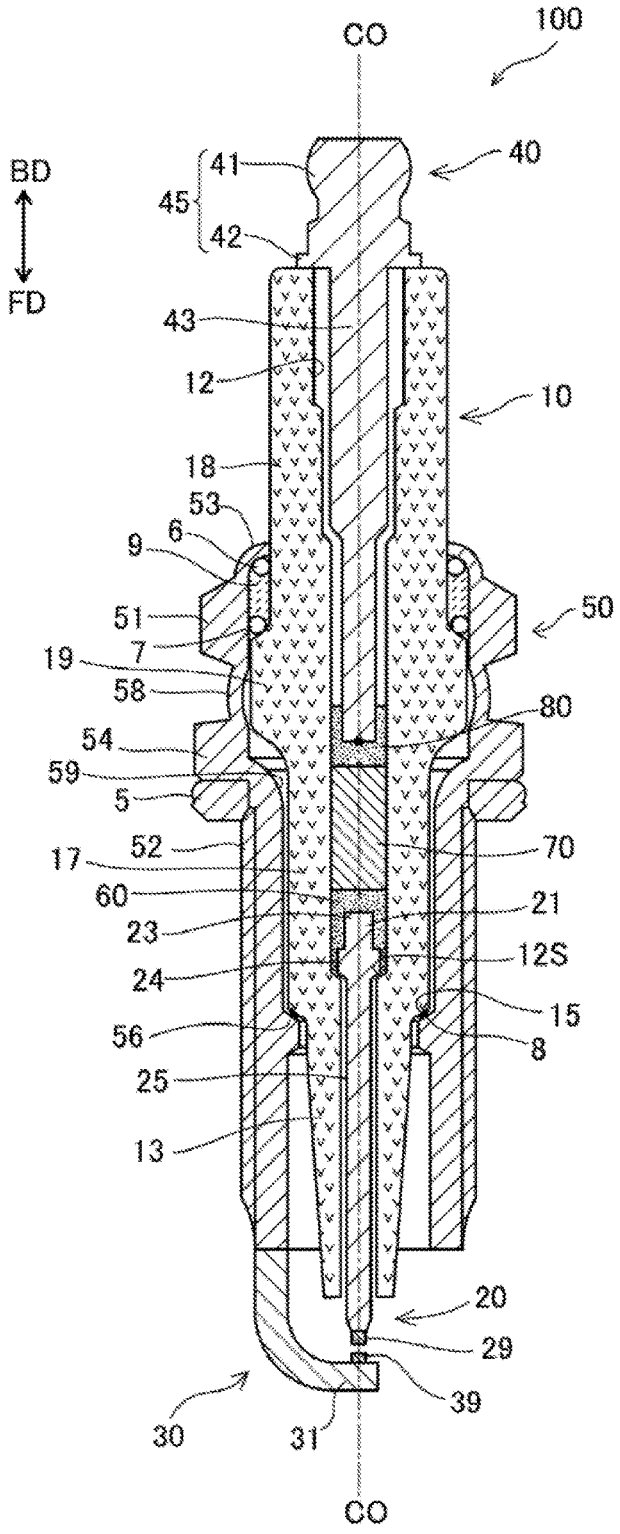
FIG. 1 is a cross-sectional view of a spark plug 100 according to an embodiment.

Hereinafter, a technique disclosed in the present specification will be described on the basis of an embodiment. FIG. 1 is a cross-sectional view of a spark plug 100 according to the present embodiment. In FIG. 1, an alternate long and short dashed line indicates an axis CO of the spark plug 100. The radial direction of a circle centered on the axis CO is referred to simply as "radial direction", and the circumferential direction of the circle centered on the axis CO is referred to simply as "circumferential direction". The downward direction in FIG. 1 is referred to as forward or a front end direction FD, and the upward direction in FIG. 1 is referred to as rearward or a rear end direction BD. The lower side in FIG. 1 is referred to as a front side, and the upper side in FIG. 1 is referred to as a rear side. The spark plug 100 includes an insulator 10, a center electrode 20, a ground electrode 30, a metal terminal 40, and a metallic shell 50.

The insulator (ceramic insulator) 10 is formed by baking alumina or the like. The insulator 10 is a substantially cylindrical member having an axial bore 12 which extends along the axis CO to penetrate the insulator 10. The insulator 10 includes a flange portion 19, a rear trunk portion 18, a front trunk portion 17, a step portion 15, and a leg portion 13. The rear trunk portion 18 is located at the rear side with respect to the flange portion 19 and has an outer diameter smaller than the outer diameter of the flange portion 19. The front trunk portion 17 is located at the front side with respect to the flange portion 19 and has an outer diameter smaller than the outer diameter of the flange portion 19. The leg portion 13 is located at the front side with respect to the front trunk portion 17 and has an outer diameter smaller than the outer diameter of the front trunk portion 17. The leg portion 13 is exposed to a combustion chamber of an internal combustion engine (not shown) when the spark plug 100 is mounted on the internal combustion engine. The step portion 15 is formed between the leg portion 13 and the front trunk portion 17.

The metallic shell 50 is formed from a conductive metal material (e.g., a low-carbon steel material) and is a cylindrical metal member for fixing the spark plug 100 to an engine head (not shown) of the internal combustion engine. The metallic shell 50 has an insertion hole 59 extending along the axis CO and through the metallic shell 50. The metallic shell 50 is disposed on the outer periphery of the insulator 10. That is, the insulator 10 is disposed and held within the insertion hole 59 of the metallic shell 50. The front end of the insulator 10 protrudes to the front side with respect to the front end of the metallic shell 50. The rear end of the insulator 10 protrudes to the rear side with respect to the rear end of the metallic shell 50.

The metallic shell 50 includes: a hexagonal columnar tool engagement portion 51 for engaging a spark plug wrench; a mounting screw portion 52 for mounting the spark plug 100 to the internal combustion engine; and a flange-like seat portion 54 formed between the tool engagement portion 51 and the mounting screw portion 52. A nominal diameter of the mounting screw portion 52 is set to any of M8 (8 mm (millimeters)), M10, M12, M14, and M18.

An annular gasket 5 which is formed by bending a metal plate is inserted between the mounting screw portion 52 and the seat portion 54 of the metallic shell 50. The gasket 5 seals a gap between the spark plug 100 and the internal combustion engine (engine head) when the spark plug 100 is mounted on the internal combustion engine.

The metallic shell 50 further includes: a thin crimp portion 53 provided at the rear side of the tool engagement portion 51; and a thin compressive deformation portion 58 provided between the seat portion 54 and the tool engagement portion 51. Annular packings 6 and 7 are disposed in an annular region formed between the inner peripheral surface of a portion of the metallic shell 50 from the tool engagement portion 51 to the crimp portion 53, and the outer peripheral surface of the rear trunk portion 18 of the insulator 10. The space between the two packings 6 and 7 in this region is filled with powder of a talc 9. The rear end of the crimp portion 53 is bent radially inward and fixed to the outer peripheral surface of the insulator 10. The compressive deformation portion 58 of the metallic shell 50 compressively deforms when the crimp portion 53, which is fixed to the outer peripheral surface of the insulator 10, is pressed toward the front side during manufacturing. The insulator 10 is pressed within the metallic shell 50 toward the front side via the packings 6 and 7 and the talc 9 due to the compressive deformation of the compressive deformation portion 58. The step portion 15 (ceramic insulator side step portion) of the insulator 10 is pressed by a step portion 56 (metallic shell side step portion), which is formed on the inner periphery of the mounting screw portion 52 of the metallic shell 50, via an annular plate packing 8 made of metal. As a result, the plate packing 8 prevents gas in the combustion chamber of the internal combustion engine from leaking to the outside through a gap between the metallic shell 50 and the insulator 10.

The center electrode 20 includes: a bar-shaped center electrode body 21 extending along the axis CO; and a columnar center electrode tip 29 joined to the front end of the center electrode body 21. The center electrode body 21 is disposed within the axial bore 12 and at a front portion of the insulator 10. The center electrode body 21 is formed from, for example, nickel or an alloy containing nickel as a principal component. The center electrode body 21 includes: a flange portion 24 provided at a predetermined position in the axial direction; a head portion 23 which is a portion at the rear side with respect to the flange portion 24; and a leg portion 25 which is a portion at the front side with respect to the flange portion 24. The flange portion 24 is supported by a step portion 12S formed in the axial bore 12 of the insulator 10. The front end of the leg portion 25, that is, the front end of the center electrode body 21 protrudes to the front side with respect to the front end of the insulator 10. The rear end of the head portion 23, that is, the rear end of the center electrode body 21 is located in the axial bore 12 of the insulator 10. The center electrode tip 29 is formed from, for example, a noble metal material having a high melting point, and is joined to the front end of the center electrode body 21.

The ground electrode 30 includes: a ground electrode body 31 joined to the front end of the metallic shell 50; and a columnar ground electrode tip 39. The rear end of the ground electrode body 31 is joined to the front end surface of the metallic shell 50. The ground electrode body 31 is formed by using a metal having high corrosion resistance, for example, a nickel alloy. The ground electrode tip 39 is formed from a noble metal material having a high melting point, and is joined to a surface of a front end portion of the ground electrode body 31, which surface faces the center electrode 20.

The rear end surface of the ground electrode tip 39 and the front end surface of the center electrode tip 29 form a gap in which spark discharge occurs. The vicinity of the gap is also referred to a firing end of the spark plug 100.

The metal terminal 40 is a bar-shaped member extending along the axis CO. The metal terminal 40 is formed from a conductive metal material (e.g., low-carbon steel). The metal terminal 40 includes: a trunk portion 43 having a front end located at the rear side with respect to the rear end of the center electrode 20; and a head portion 45 located at the rear side with respect to the trunk portion 43. The trunk portion 43 is disposed inside the axial bore 12 of the insulator 10, and the head portion 45 is exposed to the outside at the rear side with respect to the insulator 10. The head portion 45 includes: a flange portion 42 (terminal jaw portion); and a cap attachment portion 41 located at the rear side with respect to the flange portion 42.

A resistor 70 for reducing noise generated when spark occurs is disposed inside the axial bore 12 of the insulator 10 and between the front end of the metal terminal 40 and the rear end of the center electrode 20. In the axial bore 12, a gap between the resistor 70 and the center electrode 20 is filled with a conductive seal member 60. In addition, a gap between the resistor 70 and the trunk portion 43 of the metal terminal 40 is filled with a conductive seal member 80. Accordingly, the front end of the trunk portion 43 (i.e., the front end of the metal terminal 40) is in contact with the conductive seal member 80 in the axial bore 12.

The spark plug 100 is mounted to an internal combustion engine of an automobile or the like and used. Specifically, when a DC voltage of about 20 kV, for example, is applied between the metal terminal 40 and the metallic shell 50, spark discharge occurs in a gap between the center electrode 20 and the ground electrode 30. The energy of the spark discharge causes ignition of fuel gas in the internal combustion engine.

A-2. Structure Around Metal Terminal 40

Figure 2:
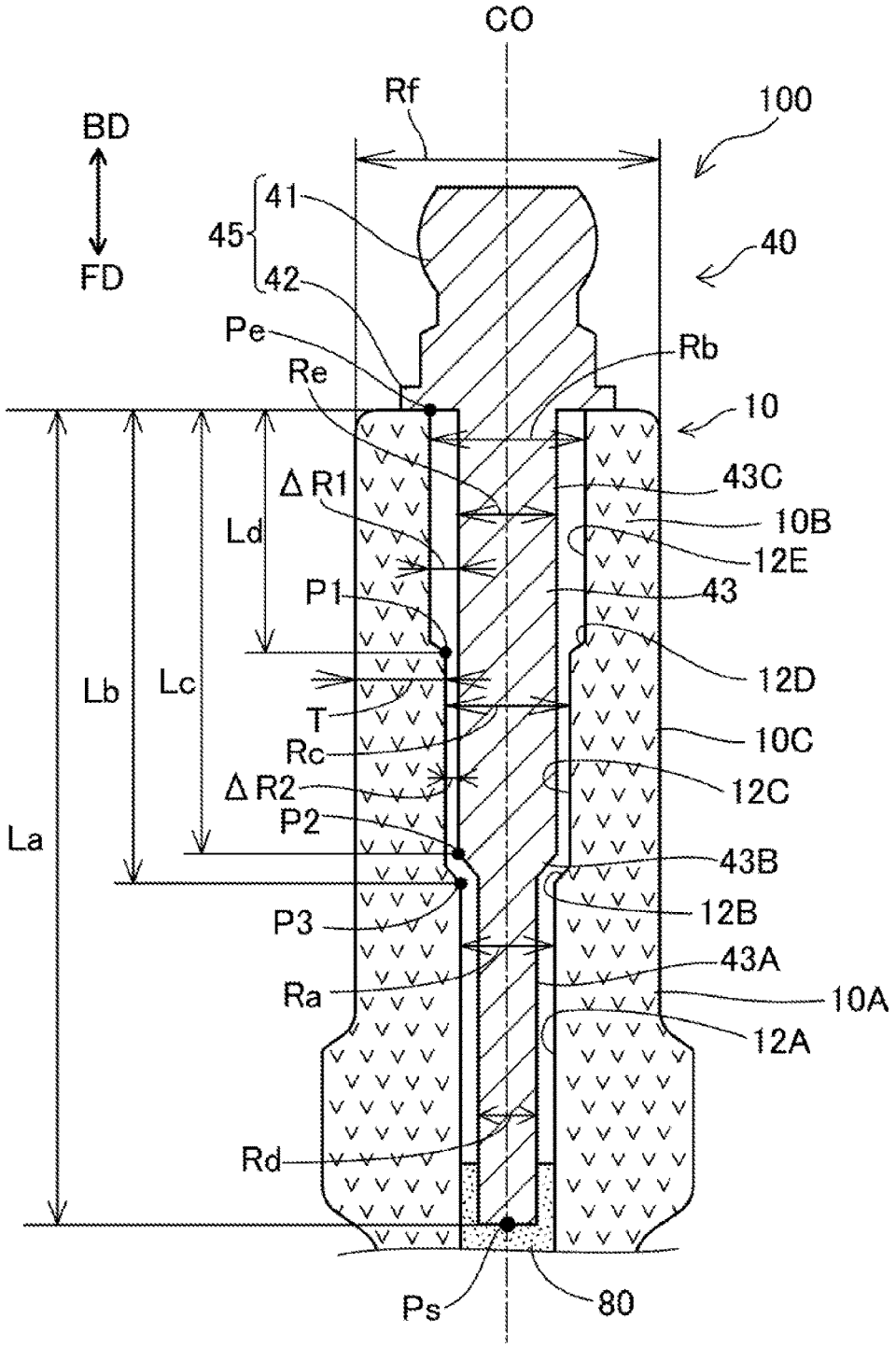
FIG. 2 is an enlarged view of a part around a metal terminal 40 in FIG. 1.

Hereinafter, the structure around the metal terminal 40 will be described in more detail. FIG. 2 is an enlarged view of a part around the metal terminal 40 in FIG. 1. The axial bore 12 of the insulator 10 includes: a first bore 12A; a second bore 12E located at the rear side with respect to the first bore 12A; and a third bore 12C located between the first bore 12A and the second bore 12E. A diameter enlarged bore 12B having a diameter increasing from the front side toward the rear side is formed between the first bore 12A and the third bore 12C, and a diameter enlarged bore 12D having a diameter increasing from the front side toward the rear side is formed between the third bore 12C and the second bore 12E. In other words, in terms of the axial bore 12, the insulator 10 includes: a cylindrical first portion 10A in which the first bore 12A is formed; a cylindrical second portion 10B in which the second bore 12E is formed; and a cylindrical third portion 10C in which the third bore 12C is formed. An inner diameter Rb of the second portion 10B (i.e., a bore diameter Rb of the second bore 12E) is larger than an inner diameter Ra of the first portion 10A (i.e., a bore diameter Ra of the first bore 12A) (Ra<Rb). An inner diameter Rc of the third portion 10C (i.e., a bore diameter Rc of the third bore 12C) is larger than the inner diameter Ra of the first portion 10A and smaller than the inner diameter Rb of the second portion 10B (Ra<Rc<Rb). A step portion at which the diameter enlarged bore 12B is formed is disposed between the first portion 10A and the third portion 10C, and a step portion at which the diameter enlarged bore 12D is formed is disposed between the third portion 10C and the second portion 10B.

The trunk portion 43 of the metal terminal 40 includes: a cylindrical front trunk portion 43A including the front end of the trunk portion 43; a cylindrical rear trunk portion 43C located at the rear side with respect to the front trunk portion 43A; and a step portion 43B located between the front trunk portion 43A and the rear trunk portion 43C. An outer diameter Re of the rear trunk portion 43C is larger than an outer diameter Rd of the front trunk portion 43A. The outer peripheral surface of the step portion 43B has a diameter increasing from the front side toward the rear side.

The front end of the front trunk portion 43A (i.e., the front end of the trunk portion 43) is disposed inside the first bore 12A of the first portion 10A.

A rear end P1 of the third portion 10C is located at the rear side with respect to a front end P2 of the rear trunk portion 43C. Therefore, the rear trunk portion 43C is located inside the second portion 10B of the insulator 10 and inside a portion, at the rear side, of the third portion 10C.

A rear end P3 of the first portion 10A is located at the front side with respect to the front end P2 of the rear trunk portion 43C. Therefore, the front trunk portion 43A is located inside the first portion 10A of the insulator 10.

Further, as shown in FIG. 2, the position of the step portion 43B of the trunk portion 43 in the axial direction is almost the same as the position of the diameter enlarged bore 12B of the insulator 10 in the axial direction. Therefore, the outer peripheral surface (diameter enlarged surface) of the trunk portion 43 faces the inner peripheral surface (diameter enlarged surface) of the insulator 10, which surface forms the diameter enlarged bore 12B.

The trunk portion 43 of the metal terminal 40 and the second portion 10B of the insulator 10 are not in contact with each other over the entire periphery thereof in the circumferential direction. That is, the outer peripheral surface of the rear trunk portion 43C of the trunk portion 43 and the inner peripheral surface of the second portion 10B are separated from each other. In addition, as shown in FIG. 2, the trunk portion 43 of the metal terminal 40 and the third portion 10C of the insulator 10 are not in contact with each other over the entire periphery thereof in the circumferential direction. A gap ΔR1 between the outer peripheral surface of the rear trunk portion 43C and the inner peripheral surface of the second portion 10B is larger than a gap ΔR2 between the outer peripheral surface of the rear trunk portion 43C and the inner peripheral surface of the third portion 10C.

The thickness (wall thickness) of the third portion 10C in the radial direction is denoted by T. In addition, the outer diameter of a portion, at the rear side, of the insulator 10, that is, the outer diameter of the third portion 10C and the second portion 10B is denoted by Rf. The thickness T of the third portion 10C can be expressed by $T=\{(Rf-Rc)/2\}$ by using the outer diameter Rf of the third portion 10C, and the inner diameter Rc of the third portion 10C.

The length in the axial direction from a rear end Pe of the insulator 10 to the rear end P1 of the third portion 10C is denoted by Ld. In addition, the length in the axial direction from the rear end Pe of the insulator 10 to the rear end P3 of the first portion 10A is denoted by Lb. The length in the axial direction from the rear end Pe of the insulator 10 (i.e., the rear end of the trunk portion 43) to a front end Ps of the trunk portion 43 is denoted by La. The length in the axial direction from the rear end Pe of the insulator 10 (i.e., the rear end of the trunk portion 43) to the front end P2 of the rear trunk portion 43C is denoted by Lc.

B. First Evaluation Test

An impact resistance test for evaluating resistance to impact was executed using samples of a spark plug. In the first evaluation test, as shown in Table 1, five types of samples A1 to A5 of the spark plug 100 were produced. The dimensions common to each sample are as follows:

the length La from the rear end Pe of the insulator 10 to the front end Ps of the trunk portion 43: 41 mm;

the length Lb from the rear end Pe of the insulator 10 to the rear end P3 of the first portion 10A: 19.2 mm;

the length Lc from the rear end Pe of the insulator 10 to the front end P2 of the rear trunk portion 43C: 7.0 mm;

the inner diameter Ra of the first portion 10A: 3 mm;

the inner diameter Rb of the second portion 10B: 3.9 mm;

the inner diameter Rc of the third portion 10C: 3.4 mm;

the outer diameter Rd of the front trunk portion 43A: 2.85 mm;

the outer diameter Re of the rear trunk portion 43C: 3.2 mm; and the outer diameter Rf of the third portion 10C: 9.0 mm.

TABLE 1

| Sample number | Ld (mm) | Impact resistance test |
|---|---|---|
| A1 | 0.5 | D |
| A2 | 0.9 | D |
| A3 | 1 | B |
| A4 | 3 | B |
| A5 | 5 | B |

The five types of samples A1 to A5 have different lengths Ld in the axial direction from the rear end Pe of the insulator 10 to the rear end P1 of the third portion 10C, which are 0.5 mm, 0.9 mm, 1 mm, 3 mm, and 5 mm, respectively. In the samples A1 to A5, the insulator 10 was formed by using alumina, and the metal terminal 40 was formed by using low-carbon steel.

In the impact resistance test, impact was applied to each sample under the conditions specified in section 7.4 of JIS B 8031:2006 (Internal combustion engine—Spark plugs). The insulator 10 of each sample after the test was visually checked to confirm whether crack occurred in the insulator 10. In the test, for each type of sample, ten pieces of the sample were tested.

Then, a sample for which cracking occurrence was not observed in any of the 10 pieces of the sample was evaluated as "A". A sample for which cracking occurrence was observed in more than or equal to 1 and less than or equal to 3 pieces out of the 10 pieces of the sample was evaluated as "B". A sample for which cracking occurrence was observed in more than or equal to 4 and less than or equal to 6 pieces out of the 10 pieces of the sample was evaluated as "C". A sample for which cracking occurrence was observed in more than or equal to 7 pieces out of the 10 pieces of the sample was evaluated as "D".

The samples A1 and A2 having the length Ld smaller than 1 mm were evaluated as "D", and the samples A3 to A5 having the length Ld larger than or equal to 1 mm were evaluated as "B". The reason for this is considered as follows. When impact is applied to the spark plug 100, the metal terminal 40 vibrates, with the front end Ps of the front trunk portion 43A fixed in the insulator 10 by the seal member 80 (refer to FIG. 2) as a fulcrum, in the axial bore 12 of the insulator 10. In the spark plug 100, when vibration occurs, the rear end P1 of the third portion 10C becomes a contact point that comes into contact with the trunk portion 43 of the metal terminal 40. That is, when vibration occurs, the rear end P1 of the third portion 10C collides against the trunk portion 43, and impact is applied from the metal terminal 40 to the insulator 10 in the radial direction. Therefore, in the spark plug 100, the distance from the fulcrum Ps of vibration to the point of action P1 of impact is (La−Ld).

Figure 3:
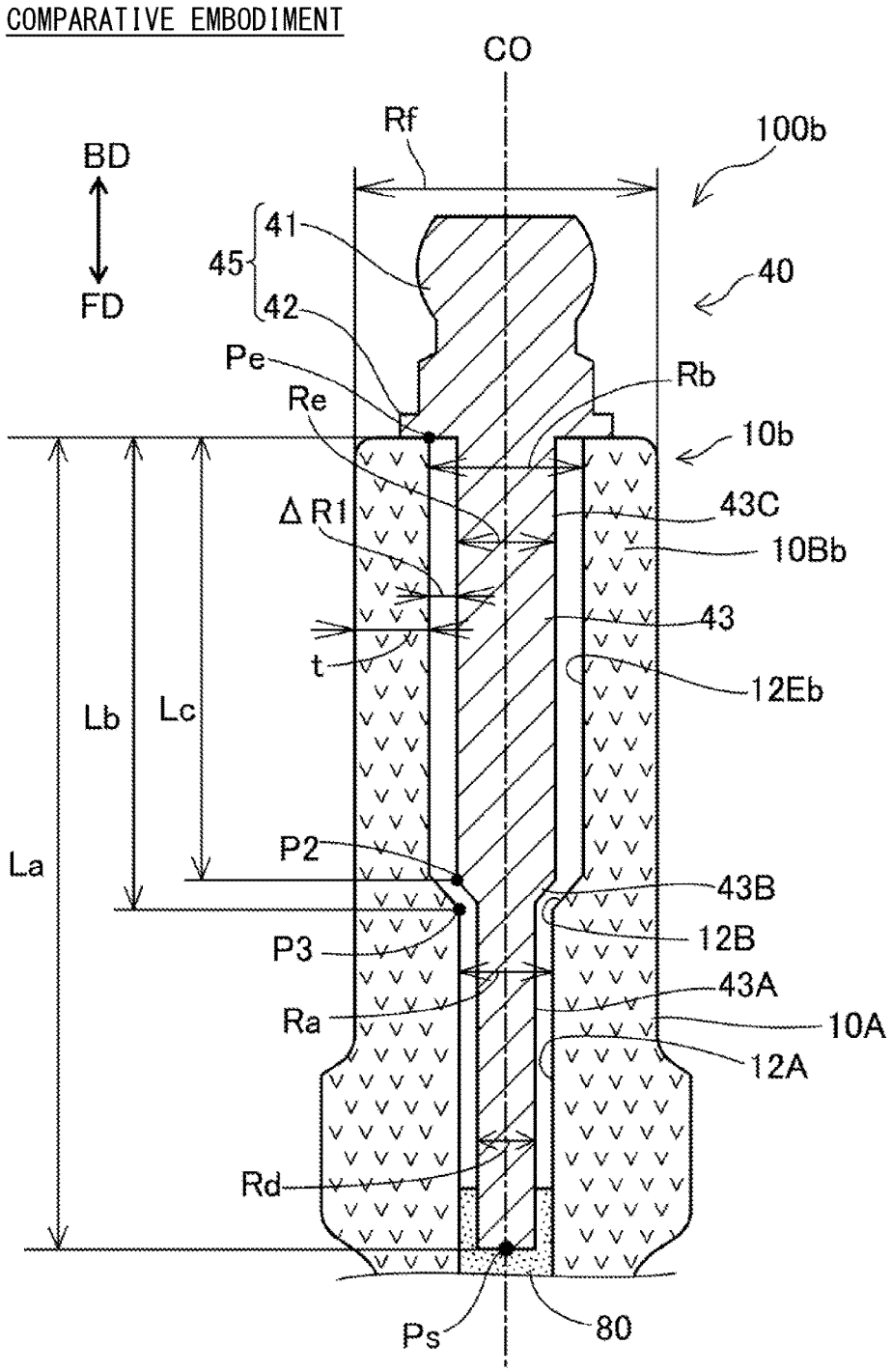
FIG. 3 is a view showing a structure around a metal terminal 40 of a spark plug 100*b* according to a comparative embodiment.

FIG. 3 shows a structure around a metal terminal 40 of a spark plug 100*b* according to a comparative embodiment. It is assumed that an insulator 10*b* of the spark plug 100*b* shown in FIG. 3 does not have the third portion 10C. Since the insulator 10*b* does not have the third portion 10C, a second portion 10Bb having an inner diameter Rb is located at a position where the second portion 10B and the third portion 10C are disposed in FIG. 2, at the rear side of the diameter enlarged bore 12B disposed at the rear side of the first portion 10A. In this case, the rear end Pe of the second portion 10Bb (i.e., the rear end Pe of the insulator 10) becomes a contact point that comes into contact with the trunk portion 43 of the metal terminal 40 when vibration occurs. Therefore, in the spark plug 100*b*, the distance from the fulcrum Ps of vibration to the point of action Pe of impact is La.

As is seen from the above description, in the spark plug 100 according to the embodiment, the distance (La−Ld) from the fulcrum Ps of vibration to the point of action P1 of impact is smaller than the distance La from the fulcrum Ps of vibration to the point of action Pe of impact in the spark plug 100*b* according to the comparative embodiment. Thus, impact (moment) applied to the insulator 10 due to the metal terminal 40 can be reduced. As a result, impact resistance of the insulator 10 can be improved.

However, when the length Ld is excessively small, the distance (La−Ld) from the fulcrum Ps of vibration to the point of action P1 of impact cannot be sufficiently reduced, which may cause insufficient impact resistance. It is found from the result of the first evaluation test that if the length Ld is 1 mm or larger, impact resistance can be improved by reducing the distance (La−Ld) from the fulcrum Ps of vibration to the point of action P1 of impact. In the spark plug 100 shown in FIG. 2, if the third portion 10C is formed so that the length of the second portion 10B in the axial direction is 1 mm or larger, the length Ld can be set to 1 mm or larger. In other words, it is found that if the third portion 10C is formed so that the second portion 10B includes a portion, of the insulator 10, 1 mm or more distant from the rear end of the insulator 10 toward the front side, impact resistance of the insulator 10 can be improved.

C. Second Evaluation Test

Further, a second evaluation test was executed in order to verify the structure that can improve impact resistance. In the second evaluation test, as shown in Table 2, five types of samples B1 to B5 were produced. The dimensions common to each sample are as follows:

the length La from the rear end Pe of the insulator 10 to the front end Ps of the trunk portion 43: 41 mm;

the length Lb from the rear end Pe of the insulator 10 to the rear end P3 of the first portion 10A: 19.2 mm;

the length Lc from the rear end Pe of the insulator 10 to the front end P2 of the rear trunk portion 43C: 10 mm;

the inner diameter Ra of the first portion 10A: 3 mm;

the inner diameter Rb of the second portion 10B: 3.9 mm;

the inner diameter Rc of the third portion 10C: 3.4 mm;

the outer diameter Rd of the front trunk portion 43A: 2.85 mm;

the outer diameter Re of the rear trunk portion 43C: 3.2 mm; and the outer diameter Rf of the third portion 10C: 9.0 mm.

The materials of the respective components such as the insulator 10 and the metal terminal 40 are the same as those of the first evaluation test. Further, details of the impact resistance test for each sample and ratings for evaluation are the same as those of the first evaluation test.

TABLE 2

| Sample number | Ld (mm) | Lc-Ld (mm) | Impact resistance test |
|---|---|---|---|
| B1 | 5 | 5 | B |
| B2 | 9 | 1 | B |
| B3 | 10 | 0 | C |
| B4 | 11 | −1 | D |
| B5 | 15 | −5 | D |

The five types of samples B1 to B5 have different lengths Ld in the axial direction from the rear end Pe of the insulator 10 to the rear end P1 of the third portion 10C, which are 5 mm, 9 mm, 10 mm, 11 mm, and 15 mm, respectively. The length Lc from the rear end Pe of the insulator 10 to the front end P2 of the rear trunk portion 43C is fixed to 10 mm. As a result, in the two samples B1 and B2, (Lc−Ld) has a value larger than 0, and the rear end P1 of the third portion 10C of the insulator 10 is located at the rear side with respect to the front end P2 of the rear trunk portion 43C, like in the spark plug 100 shown in FIG. 2.

Meanwhile, in the samples B4 and B5, (Lc−Ld) has a value smaller than 0. In this case, in contrast to the spark plug 100 shown in FIG. 2, the rear end P1 of the third portion 10C of the insulator 10 is located at the front side with respect to the front end P2 of the rear trunk portion 43C. In the sample B3, (Lc−Ld)=0. In this case, in contrast to the spark plug 100 shown in FIG. 2, the rear end P1 of the third portion 10C of the insulator 10 is the same as the front end P2 of the rear trunk portion 43C.

As seen from the above description, the two samples B1 and B2 are samples of the spark plug according to the embodiment shown in FIG. 2, and the three samples B3 to B5 are samples of a spark plug according to a comparative embodiment different from the embodiment shown in FIG. 2.

The two samples B1 and B2 having (Lc−Ld) larger than 0 were evaluated as "B". On the other hand, the sample B3 having (Lc−Ld)=0 was evaluated as "C", and the two samples B4 and B5 having (Lc−Ld) smaller than 0 were evaluated as "D". The reason for this is considered as follows. When (Lc−Ld) is larger than 0, that is, when the rear end P1 of the third portion 10C of the insulator 10 is located at the rear side with respect to the front end P2 of the rear trunk portion 43C, the rear end P1 of the third portion 10C faces, in the radial direction, the rear trunk portion 43C having the relatively large outer diameter Re. As a result, it is assured that the rear end P1 of the third portion 10C becomes a contact point that comes into contact with the trunk portion 43 of the metal terminal 40 when vibration occurs. As a result, impact resistance of the insulator 10 can be sufficiently improved.

On the other hand, when (Lc−Ld) is equal to or smaller than 0, that is, when the rear end P1 of the third portion 10C of the insulator 10 is located at the front side with respect to the front end P2 of the rear trunk portion 43C, the rear end P1 of the third portion 10C faces, in the radial direction, the front trunk portion 43A having the relatively small outer diameter Rd. As a result, it is not assured that the rear end P1 of the third portion 10C becomes a contact point that comes into contact with the trunk portion 43 of the metal terminal 40 when vibration occurs, and the rear end Pe of the second portion 10B is highly likely to become a contact point that comes into contact with the trunk portion 43. As a result, impact resistance of the insulator 10 cannot be sufficiently improved.

Figure 4:
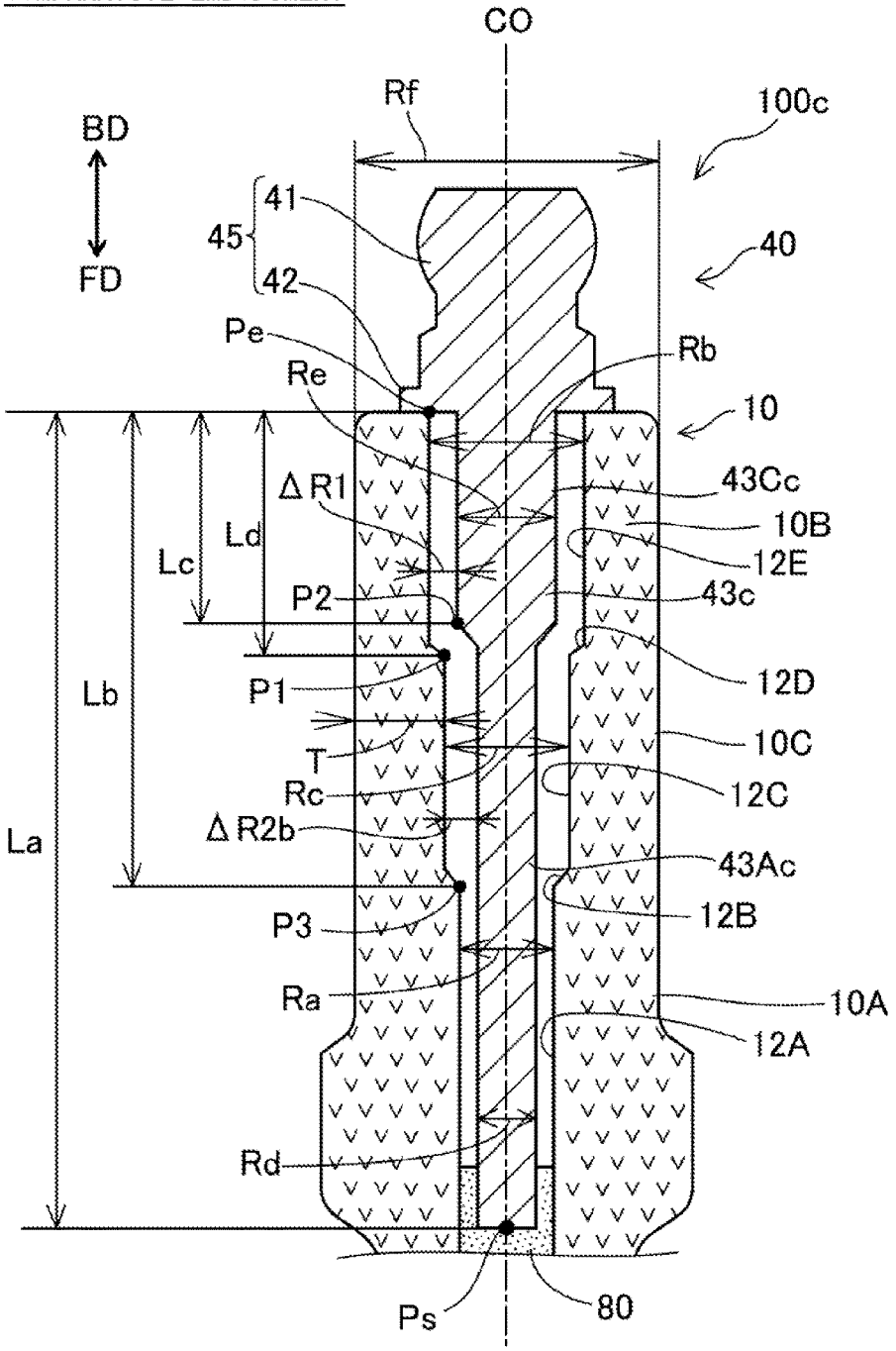
FIG. 4 is a view showing a structure around a metal terminal 40 of a spark plug 100*c* according to a comparative embodiment.

FIG. 4 shows a structure around a metal terminal 40 of a spark plug 100*c* according to a comparative embodiment. In the example shown in FIG. 4, since the length of a rear trunk portion 43Cc in the axial direction is relatively small and the length of a front trunk portion 43Ac in the axial direction is relatively large, the rear end P1 of the third portion 10C of the insulator 10 is located at front side with respect to the front end P2 of the rear trunk portion 43Cc. In this case, since the rear end P1 of the third portion 10C faces, in the radial direction, the front trunk portion 43Ac having the relatively small outer diameter Rd, a gap ΔR2*b* between the rear end P1 of the third portion 10C of the insulator 10 and the trunk portion 43*c* becomes wider than the gap ΔR2*b* shown in FIG. 2. As a result, it is difficult to assure that the rear end P1 of the third portion 10C becomes a contact point that comes into contact with the trunk portion 43*c* of the metal terminal 40 when vibration occurs.

On the other hand, when (Lc−Ld) is 0, the rear end P1 of the third portion 10C of the insulator 10 faces, in the radial direction, the rear trunk portion 43C having the relatively large outer diameter Re, and also faces the step portion 43B having an outer diameter smaller than the outer diameter Re. Therefore, as compared to the case where (Lc−Ld) is larger than 0, it is not sufficiently assured that the rear end P1 of the third portion 10C becomes a contact point that comes into contact with the trunk portion 43 of the metal terminal 40 when vibration occurs, and the rear end Pe of the second portion 10B might become a contact point that comes into contact with the trunk portion 43. As a result, impact resistance of the insulator 10 cannot be sufficiently improved.

As seen from the above description, it is found from the result of the second evaluation test that when (Lc−Ld) is larger than 0, that is, when the rear end P1 of the third portion 10C of the insulator 10 is located at the rear side with respect to the front end P2 of the rear trunk portion 43C, impact resistance of the insulator 10 can be improved.

As described above, the results of the first evaluation test and the second evaluation test indicate that it is preferable that the second portion 10B includes a portion, of the insulator 10, 1 mm or more distant from the rear end of the insulator 10 toward the front side, and the rear end P1 of the third portion 10C is located at the rear side with respect to the front end P2 of the rear trunk portion 43C. By so doing, when the metal terminal 40 vibrates, the trunk portion 43 is more likely to come into contact with the third portion 10C relatively distant from the rear end of the insulator 10, and is less likely to come into contact with the second portion 10B. As a result, impact applied from the metal terminal 40 to the insulator 10 can be reduced, whereby cracking of the insulator 10 can be suppressed.

D. Third Evaluation Test

Further, a third evaluation test was executed in order to verify the structure that can improve impact resistance. In the third evaluation test, as shown in Table 3, eight types of samples C1 to C8 of the spark plug 100 were produced. The dimensions common to each sample are as follows:

the length La from the rear end Pe of the insulator 10 to the front end Ps of the trunk portion 43: 41 mm;

the length Lb from the rear end Pe of the insulator 10 to the rear end P3 of the first portion 10A: 19.2 mm;

the length Lc from the rear end Pe of the insulator 10 to the front end P2 of the rear trunk portion 43C: 10 mm;

the length Ld from the rear end Pe of the insulator 10 to the rear end P1 of the third portion 10C: 5.0 mm;

the inner diameter Ra of the first portion 10A: 3 mm;

the inner diameter Rb of the second portion 10B: 4.1 mm;

the inner diameter Rc of the third portion 10C: 4.0 mm;

the outer diameter Rd of the front trunk portion 43A: 2.85 mm; and the outer diameter Re of the rear trunk portion 43C: 3.8 mm.

The materials of the respective components such as the insulator 10 and the metal terminal 40 are the same as those of the first evaluation test. Further, details of the impact resistance test for each sample and ratings for evaluation are the same as those of the first evaluation test.

TABLE 3

| Sample number | Outer diameter Rf (mm) | Wall thickness of third portion T (mm) | Impact resistance test |
|---|---|---|---|
| C1 | 20 | 8 | A |
| C2 | 18 | 7 | B |
| C3 | 17 | 6.5 | B |
| C4 | 16.4 | 6.2 | B |
| C5 | 16.2 | 6.1 | B |
| C6 | 14 | 5 | B |
| C7 | 9 | 2.5 | B |
| C8 | 7.5 | 1.75 | B |

The eight types of samples C1 to C8 have different outer diameters Rf (FIG. 2) of a rear end portion of the insulator 10 including the third portion 10C, which are 20 mm, 18 mm, 17 mm, 16.4 mm, 16.2 mm, 14 mm, 9 mm, and 7.5 mm, respectively. Thereby, the eight types of samples C1 to C8 have different wall thicknesses T={(Rf−Rc)/2} (FIG. 2) of the third portion 10C, which are 8 mm, 7 mm, 6.5 mm, 6.2 mm, 6.1 mm, 5 mm, 2.5 mm, and 1.75 mm, respectively.

The sample C1 in which the wall thickness T of the third portion 10C was 8 mm was evaluated as "A", and the samples C2 to C8 in which the wall thickness T of the third portion 10C was equal to or smaller than 7 mm was evaluated as "B". In the samples C2 to C8 in which the wall thickness T of the third portion 10C was equal to or smaller than 7 mm, the reason why reduction in impact resistance was not observed even when the wall thickness T was reduced is considered to be that the insulator 10 having the third portion 10C and the second portion 10B assures that the rear end P1 of the third portion 10C becomes a contact point that comes into contact with the trunk portion 43 of the metal terminal 40 as described above.

In order to verify this, as shown in Table 4, eight types of samples D1 to D8 of the spark plug 100*b* according to the comparative embodiment shown in FIG. 3 were produced, and subjected to a similar impact resistance test. In each of the eight types of samples D1 to D8, as shown in FIG. 3, since the insulator 10*b* has no third portion, the second portion 10Bb having the inner diameter Rb is located at a position where the second portion 10B and the third portion 10C are disposed in FIG. 2, at the rear side of the diameter enlarged bore 12B disposed at the rear side of the first portion 10A. The dimensions of the respective portions, other than the third portion, of the eight types of samples D1 to D8 are the same as those of the samples C1 to C8 shown in Table 3 having the same suffix numbers. That is, the eight types of samples D1 to D8 have different outer diameters Rf (FIG. 3) of the rear end portion of the insulator 10*b* including the second portion 10Bb, which are 20 mm, 18 mm, 17 mm, 16.4 mm, 16.2 mm, 14 mm, 9 mm, and 7.5 mm, respectively. Thereby, the eight types of samples D1 to D8 have different wall thicknesses t={(Rf−Rb)/2} (FIG. 3) of the second portion 10Bb, which are 7.95 mm, 6.95 mm, 6.45 mm, 6.15 mm, 6.05 mm, 4.95 mm, 2.45 mm, and 1.7 mm, respectively.

TABLE 4

| Sample number | Outer diameter Rf (mm) | Wall thickness of second portion t (mm) | Impact resistance test |
|---|---|---|---|
| D1 | 20 | 7.95 | A |
| D2 | 18 | 6.95 | B |
| D3 | 17 | 6.45 | B |
| D4 | 16.4 | 6.15 | B |
| D5 | 16.2 | 6.05 | C |
| D6 | 14 | 4.95 | D |
| D7 | 9 | 2.45 | D |
| D8 | 7.5 | 1.7 | D |

The sample D1 in which the wall thickness t of the second portion 10Bb was 7.95 mm was evaluated as "A", and the samples D2 to D4 in which the wall thickness t of the second portion 10Bb was equal to or larger than 6.15 mm and not larger than 6.95 mm were evaluated as "B". The sample D5 in which the wall thickness t of the second portion 10Bb was 6.05 mm was evaluated as "C", and the samples D6 to D8 in which the wall thickness t of the second portion 10Bb was equal to or smaller than 4.95 mm was evaluated as "D".

As described above, in the samples D5 to D8 in which the wall thickness t of the second portion 10Bb was equal to or smaller than 6.1 mm, reduction in impact resistance was observed with reduction in the wall thickness t. Thus, it is found that, in the spark plug 100 shown in FIG. 2, since the insulator 10 has the third portion 10C and the second portion 10B, the effect of suppressing reduction in impact resistance is remarkable particularly when the wall thickness T of the rear end portion of the insulator 10 (i.e., the wall thickness T of the third portion 10C) is equal to or smaller than 6.1 mm.

The reason for this is considered as follows. As the wall thickness of the rear end portion of the insulator 10 becomes smaller, resistance to impact applied to the insulator 10 in the radial direction decreases, and resistance to vibration of the metal terminal 40 also decreases. As a result, as the wall thickness of the rear end portion of the insulator 10 becomes smaller, cracking of the insulator 10 occurs mainly due to vibration of the metal terminal 40. At this time, in the spark plug 100 according to the embodiment shown in FIG. 2, since it is assured that the rear end P1 of the third portion 10C becomes a contact point that comes into contact with the trunk portion 43 of the metal terminal 40 as described above, it is possible to suppress impact applied to the insulator 10 due to vibration of the metal terminal 40. As a result, even when the wall thickness of the rear end portion of the insulator 10 is reduced, specifically, even when the wall thickness T of the third portion 10C is equal to or smaller than 6.1 mm, it is possible to suppress cracking of the insulator 10. In contrast, in the spark plug 100*b* according to the comparative embodiment shown in FIG. 3, the rear end Pe of the second portion 10Bb (i.e., the rear end Pe of the insulator 10) becomes a contact point that comes into contact with the trunk portion 43 of the metal terminal 40 when vibration occurs, as described above. Therefore, impact applied to the insulator 10 due to vibration of the metal terminal 40 cannot be sufficiently suppressed. As a result, when the wall thickness of the rear end portion of the insulator 10 is reduced, specifically, when the wall thickness t of the second portion 10Bb is equal to or smaller than 6.1 mm, cracking of insulator 10 is more likely to occur.

From the results described above, it is found that, in the spark plug 100 according to the embodiment, it is beneficial that the wall thickness T of the third portion 10C of the insulator 10, that is, the wall thickness T in the radial direction is equal to or smaller than 6.1 mm. In this case, cracking of the insulator 10 having a relatively thin wall thickness T of the third portion 10C in the radial direction can be effectively suppressed.

E. Fourth Evaluation Test

Further, a fourth evaluation test was executed in order to verify the structure that can improve impact resistance. In the fourth evaluation test, as shown in Table 5, nine types of samples E1 to E9 of the spark plug 100 were produced. The dimensions common to each sample are as follows:

the length La from the rear end Pe of the insulator 10 to the front end Ps of the trunk portion 43: 41 mm;

the length Lb from the rear end Pe of the insulator 10 to the rear end P3 of the first portion 10A: 19.2 mm;

the length Lc from the rear end Pe of the insulator 10 to the front end P2 of the rear trunk portion 43C: 10 mm;

the length Ld from the rear end Pe of the insulator 10 to the rear end P1 of the third portion 10C; 5.0 mm;

the inner diameter Rb of the second portion 10B: 4.1 mm;

the inner diameter Rc of the third portion 10C: 4.0 mm; and the outer diameter Re of the rear trunk portion 43C: 3.8 mm.

The materials of the respective components such as the insulator 10 and the metal terminal 40 are the same as those of the first evaluation test. Further, details of the impact resistance test for each sample and ratings for evaluation are the same as those of the first evaluation test.

TABLE 5

| Sample number | Outer diameter Rf (mm) | Inner diameter of first portion Ra (mm) | Wall thickness of third portion T (mm) | Impact resistance test |
|---|---|---|---|---|
| E1 | 20 | 3 | 8 | A |
| E2 | 18 | 3 | 7 | B |
| E3 | 17 | 3 | 6.5 | B |
| E4 | 20 | 2.9 | 8 | B |

TABLE 5-continued

| Sample number | Outer diameter Rf (mm) | Inner diameter of first portion Ra (mm) | Wall thickness of third portion T (mm) | Impact resistance test |
|---|---|---|---|---|
| E5 | 18 | 2.9 | 7 | B |
| E6 | 17 | 2.9 | 6.5 | B |
| E7 | 12 | 2.7 | 4 | B |
| E8 | 9 | 2.7 | 2.5 | B |
| E9 | 7.5 | 2.7 | 1.75 | B |

The nine types of samples E1 to E9 have different inner diameters Ra (FIG. 2) of the first portion 10A of the insulator 10, which are any of 2.7 mm, 2.9 mm, and 3 mm, respectively. The outer diameter Rd (FIG. 2) of the front trunk portion 43A of the trunk portion 43 is adjusted depending on the inner diameter Ra of the first portion 10A at which the front trunk portion 43A is located. Specifically, the outer diameter Rd of the front trunk portion 43A is set to a value 0.2 mm smaller than the inner diameter Ra of the first portion 10A (i.e., Rd=Ra−0.2 mm).

Further, the samples E1 to E9 have different outer diameters Rf (FIG. 2) of the rear end portion of the insulator 10 including the third portion 10C, which are any of 20 mm, 18 mm, 17 mm, 12 mm, 9 mm, and 7.5 mm, respectively. Thereby, the nine types of samples E1 to E9 have different wall thicknesses T={(Rf−Rc)/2} (FIG. 2) of the third portion 10C, which are any of 8 mm, 7 mm, 6.5 mm, 4 mm, 2.5 mm, and 1.75 mm, respectively.

The sample E1 in which the wall thickness T of the third portion 10C was 8 mm and the inner diameter Ra of the first portion 10A was 3 mm was evaluated as "A", and the other samples E2 to E9 were evaluated as "B". The reason why reduction in impact resistance was not observed even when the inner diameter Ra of the first portion 10A was reduced is considered to be that the insulator 10 having the third portion 10C and the second portion 10B assures that the rear end P1 of the third portion 10C becomes a contact point that comes into contact with the trunk portion 43 of the metal terminal 40, as described above.

In order to verify this, as shown in Table 6, nine types of samples F1 to F9 of the spark plug 100*b* according to the comparative embodiment shown in FIG. 3 were produced, and subjected to a similar impact resistance test. The dimensions of the respective portions, other than the third portion, of the nine types of samples F1 to F9 are the same as those of the samples E1 to E9 shown in Table 5 having the same suffix numbers. That is, in each of the nine types of samples F1 to F9, the inner diameter Ra (FIG. 3) of the first portion 10A of the insulator 10 is set to any of 2.7 mm, 2.9 mm, and 3 mm. In addition, the outer diameter Rd (FIG. 3) of the front trunk portion 43A of the trunk portion 43 is set to Rd=(Ra−0.2 mm).

Further, in each of the samples F1 to F9, the outer diameter Rf (FIG. 3) of the rear end portion of the insulator 10 including the third portion 10C is set to any of 20 mm, 18 mm, 17 mm, 12 mm, 9 mm, and 7.5 mm. Thereby, the wall thickness t={(Rf−Rb)/2} (FIG. 3) of the second portion 10Bb in each of the nine types of samples F1 to F9 is set to any of 7.95 mm, 6.95 mm, 6.45 mm, 3.95 mm, 2.45 mm, and 1.7 mm.

TABLE 6

| Sample number | Outer diameter Rf (mm) | Inner diameter of first portion Ra (mm) | Wall thickness of second portion t (mm) | Impact resistance test |
|---|---|---|---|---|
| F1 | 20 | 3 | 7.95 | A |
| F2 | 18 | 3 | 6.95 | B |
| F3 | 17 | 3 | 6.45 | B |
| F4 | 20 | 2.9 | 7.95 | C |
| F5 | 18 | 2.9 | 6.95 | C |
| F6 | 17 | 2.9 | 6.45 | C |
| F7 | 12 | 2.7 | 3.95 | D |
| F8 | 9 | 2.7 | 2.45 | D |
| F9 | 7.5 | 2.7 | 1.7 | D |

The samples F1 to F3 in which the inner diameter Ra of the first portion 10A was 3 mm was evaluated as "A" or "B". That is, the sample F1 in which the wall thickness t of the second portion 10Bb was 7.95 mm was evaluated as "A", and the samples F2 and F3 in which the wall thickness t of the second portion 10Bb was 6.95 mm and 6.45 mm, respectively, were evaluated as "B". The samples F4 to F6 in which the inner diameter Ra of the first portion 10A was 2.9 mm were evaluated as "C" regardless of the wall thickness t of the second portion 10Bb. The samples F7 to F9 in which the inner diameter Ra of the first portion 10A was 2.7 mm were evaluated as "D" regardless of the wall thickness t of the second portion 10Bb.

As described above, in the samples F4 to F9 in which the inner diameter Ra of the first portion 10A was equal to or smaller than 2.9 mm, reduction in impact resistance was observed with reduction in the inner diameter Ra of the first portion 10A. From the above results, it is found that, in the spark plug 100 shown in FIG. 2, since the insulator 10 has the third portion 10C and the second portion 10B, the effect of suppressing reduction in impact resistance is remarkable particularly when the inner diameter Ra of the first portion 10A of the insulator 10 is equal to or smaller than 2.9 mm.

The reason for this is considered as follows. As the inner diameter Ra of the first portion 10A becomes smaller, the outer diameter Rd of the front trunk portion 43A of the metal terminal 40 located inside the first portion 10A has to be made smaller. When the outer diameter Rd of the front trunk portion 43A becomes smaller, rigidity of the front trunk portion 43A is reduced, whereby amplitude of vibration is increased. As a result, when impact is applied to the spark plug 100, the frequency of the trunk portion 43 of the metal terminal 40 coming into contact with the insulator 10 in the radial direction is increased. Accordingly, the insulator 10 becomes easy to crack, leading to reduction in impact resistance. Thus, as the inner diameter Ra of the first portion 10A becomes smaller, cracking of the insulator 10 occurs mainly due to vibration of the metal terminal 40. At this time, in the spark plug 100 according to the embodiment shown in FIG. 2, it is assured that the rear end P1 of the third portion 10C becomes a contact point that comes into contact with the trunk portion 43 of the metal terminal 40, as described above. Therefore, impact applied to the insulator 10 due to vibration of the metal terminal 40 can be suppressed. As a result, even when the inner diameter Ra of the first portion 10A becomes smaller, specifically, even when the inner diameter Ra of the first portion 10A is equal to or smaller than 2.9 mm, cracking of the insulator 10 can be suppressed. In contrast, in the spark plug 100*b* according to the comparative embodiment shown in FIG. 3, as described above, the rear end Pe of the second portion 10Bb (i.e., the rear end Pe of the insulator 10) becomes a contact point that comes into contact with the trunk portion 43 of the metal terminal 40 when vibration occurs. As a result, impact applied to the insulator 10 due to vibration of the metal terminal 40 cannot be sufficiently suppressed. Accordingly, when the inner diameter Ra of the first portion 10A becomes smaller, specifically, when the inner diameter Ra of the first portion 10A is equal to or smaller than 2.9 mm, cracking of the insulator 10 is more likely to occur.

From the results described above, it is found that the inner diameter Ra of the first portion 10A being equal to or smaller than 2.9 mm is beneficial in the spark plug 100 according to the embodiment. In this case, cracking of the insulator 10 can be effectively suppressed although vibration is likely to occur because of the relatively small outer diameter Rd of the front trunk portion 43A of the metal terminal 40.

Figure 5:
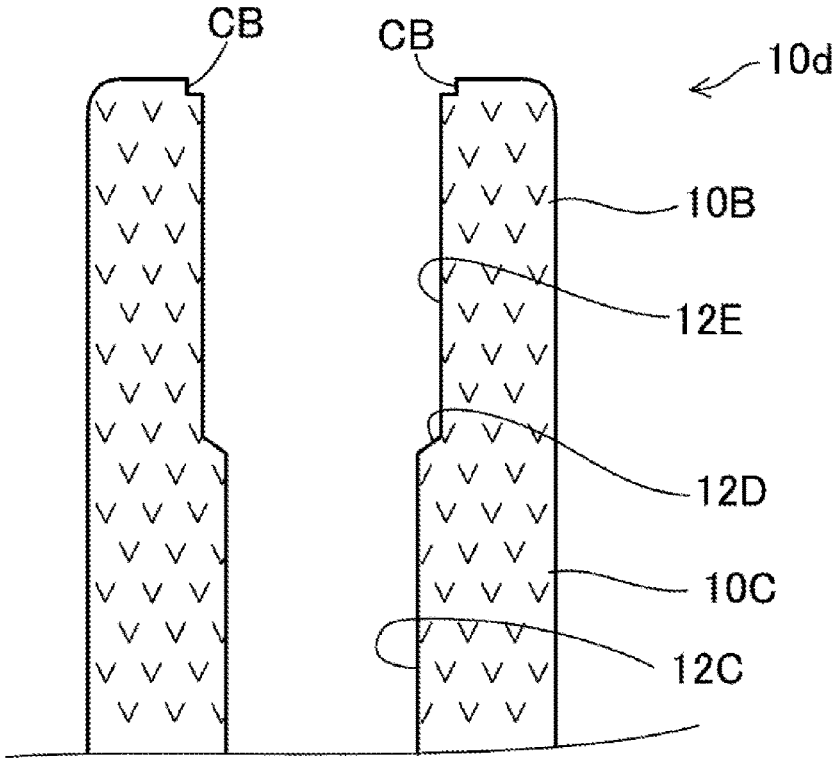
FIG. 5 is a cross-sectional view of an insulator 10*d* of a spark plug according to a modification.

F. Modifications (1) FIG. 5 is a cross-sectional view of an insulator 10*d* of a spark plug according to a modification. In FIG. 5, the components other than the insulator 10*d*, such as the metal terminal 40, are not shown. As shown in FIG. 5, in the insulator 10*d*, a counter bore CB is formed at the rear side with respect to the second portion 10B. This counter bore CB may be formed for some reason in manufacture of the insulator. The counter bore CB has an inner diameter slightly larger than the inner diameter of the second portion 10B. The length of the counter bore CB in the axial direction is 0.3 to 0.6 mm. Regardless of whether the counter bore CB is present, the second portion 10B may include a portion, of the insulator 10*d*, 1 mm or more distant from the rear end of the insulator 10*d* toward the front side. In addition, between the second portion 10B and the first portion 10A, the third portion 10C may be located which has an inner diameter larger than that of the first portion 10A and smaller than that of the second portion 10B. In this case, as understood from the result of the first evaluation test, impact applied from the metal terminal 40 to the insulator 10*d* can be reduced, whereby cracking of the insulator 10*d* can be suppressed.

Figure 6:
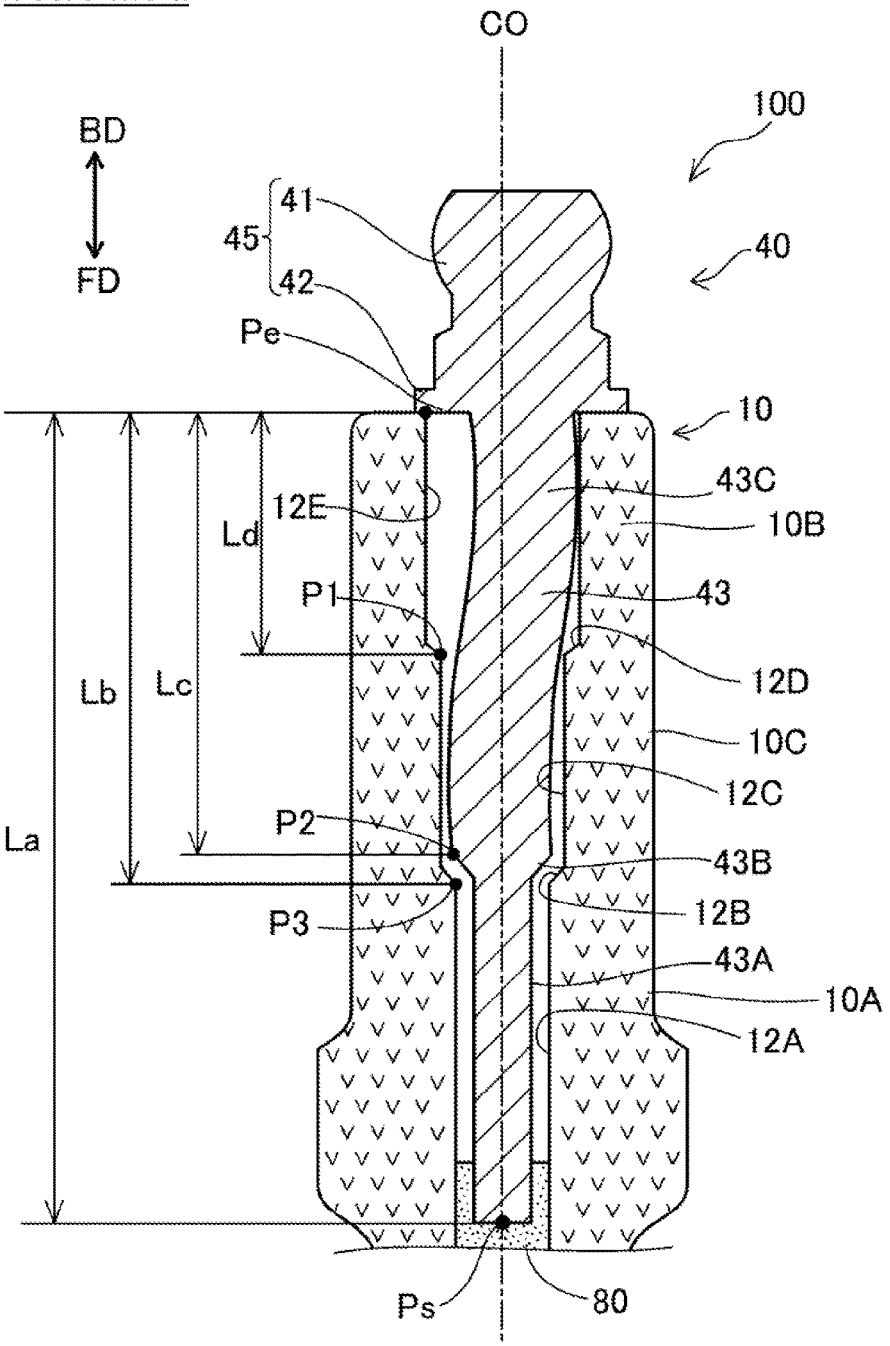
FIG. 6 is a first view showing a structure around a metal terminal 40 of a spark plug according to a modification.

(2) FIG. 6 is a first view showing the structure around the metal terminal 40 of a spark plug according to a modification. In this modification, the same components as those of the spark plug 100 according to the embodiment, such as the insulator 10, the metal terminal 40, and the seal member 80 are used. In manufacturing the spark plug, the trunk portion 43 of the metal terminal 40 is pressed into the axial bore 12 so that raw material powder of the seal member 60, the resistor 70, and the seal member 80, which has been charged into the axial bore 12 of the insulator 10, is compressed by the front end of the trunk portion 43 of the metal terminal 40. At this time, since a force for compressing the metal terminal 40 in the axial direction is applied to the metal terminal 40, the metal terminal 40 may deform. In the example shown in FIG. 6, the rear trunk portion 43C curves, and the outer peripheral surface of the rear trunk portion 43C is in contact with the inner peripheral surface of the second portion 10B of the insulator 10.

Figure 7:
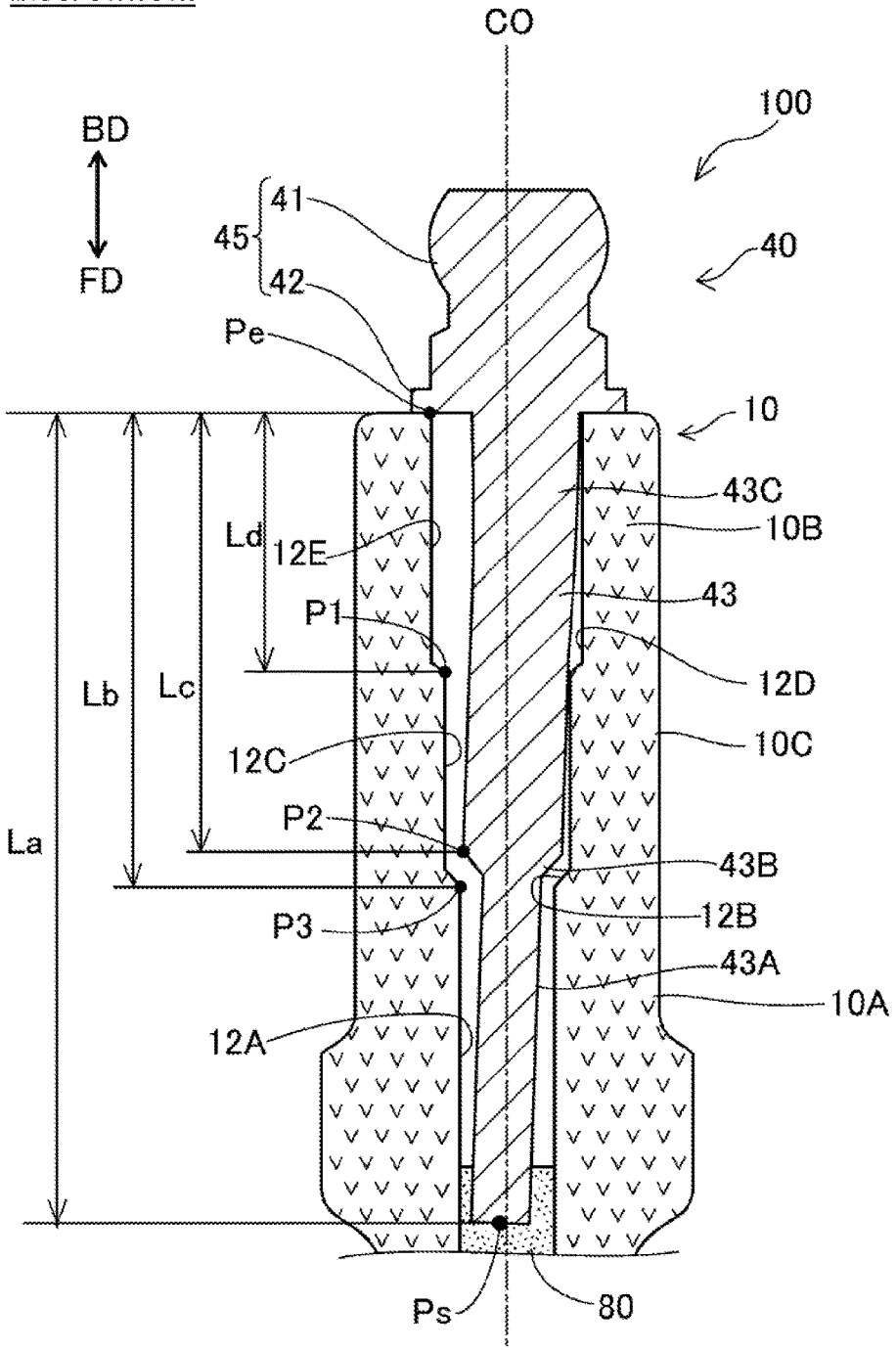
FIG. 7 is a second view showing a structure around a metal terminal 40 of a spark plug according to a modification.

FIG. 7 is a second view showing the structure around the metal terminal 40 of the spark plug according to the modification. In manufacturing the spark plug, when the trunk portion 43 of the metal terminal 40 is pressed into the axial bore 12 as described above, the axis of the metal terminal 40 may be inclined with respect to the axis of the insulator 10 due to manufacturing error. In the example shown in FIG. 7, due to the inclination of the metal terminal 40, the outer peripheral surface of the rear trunk portion 43C is in contact with the inner peripheral surface of the second portion 10B of the insulator 10.

As described above, due to either or both of deformation and inclination of the metal terminal 40 during manufacturing, the outer peripheral surface of the rear trunk portion 43C of the metal terminal 40 may be, at a part thereof in the circumferential direction, in contact with the second portion 10B of the insulator 10 or the inner peripheral surface of the third portion 10C. That is, the trunk portion 43 of the metal terminal 40 and the inner peripheral surface of the insulator 10 may be in non-contact with each other at a part in the circumferential direction, and may be in contact with each other at another part in the circumferential direction. Also in this case, when impact is applied to the spark plug, the trunk portion 43 of the metal terminal 40 can be prevented from coming into contact with a part of the rear end of the second portion 10B of the insulator 10 (e.g., the rear end Pe shown in FIGS. 6 and 7), which part is usually in non-contact with the trunk portion 43 of the metal terminal 40. As a result, cracking of the insulator 10 can be effectively suppressed like in the embodiment.

Generally speaking, at least a part of the trunk portion 43 of the metal terminal 40 is preferably in non-contact with the inner peripheral surface of the insulator 10. For example, the rear trunk portion 43C of the metal terminal 40 and the inner peripheral surface of the second portion 10B of the insulator 10 are preferably in non-contact with each other at at least a part of the entire periphery in the circumferential direction. Likewise, the rear trunk portion 43C of the metal terminal 40 and the inner peripheral surface of the third portion 10C of the insulator 10 are preferably in non-contact with each other at at least a part of the entire periphery in the circumferential direction.

(3) The materials of the insulator 10 and the metal terminal 40 are merely examples, and are not limited to the above-described materials. For example, although the insulator 10 is formed by using the ceramic material containing alumina ($Al_2O_3$) as a principal component, the insulator 10 may be formed by using a ceramic material containing another compound (e.g., AlN, $ZrO_2$, SiC, $TiO_2$, $Y_2O_3$ or the like) as a principal component instead.

(4) The specific structure of the spark plug 100 shown in FIG. 2 is merely an example, and the present invention is not limited thereto. For example, a spark plug having no resistor 70 may be adopted. Further, regarding the structure of the firing end including the center electrode and the ground electrode, any other structure, for example, a structure in which a center electrode and a ground electrode face in the radial direction, may be adopted. In addition, the material, shape, and the like of the metallic shell 50 may be changed according to need.

Although the present invention has been described above based on the embodiments and the modified embodiments, the above-described embodiments of the invention are intended to facilitate understanding of the present invention, but not as limiting the present invention. The present invention can be changed and modified without departing from the gist thereof and the scope of the claims and equivalents thereof are encompassed in the present invention.

DESCRIPTION OF REFERENCE NUMERALS

5 gasket
6 packing
8 plate packing
9 talc
10 insulator
23 axial bore
12A first bore
12B second bore
12C third bore
13 leg portion
15 step portion
17 front trunk portion
18 rear trunk portion
19 flange portion
20 center electrode
21 center electrode body
23 head portion
24 flange portion
25 leg portion
29 center electrode tip
30 ground electrode
31 ground electrode body
39 ground electrode tip
40 metal terminal
41 cap attachment portion
42 flange portion
43 leg portion
50 metallic shell
51 tool engagement portion
52 mounting screw portion
53 crimp portion
54 seat portion
56 step portion
58 compressive deformation portion
59 insertion hole
60 conductive seal
70 resistor
100 spark plug

What is claimed is:

1. A spark plug comprising:

an insulator having an axial bore extending along an axis from a rear end of the insulator toward a front end of the insulator;

a center electrode extending along the axis and having a rear end located inside the axial bore;

a metal terminal including a trunk portion and a head portion, the trunk portion located inside the axial bore and having a front end located rearward of the rear end of the center electrode, the head portion located rearward of the trunk portion and exposed to the outside at the rear end of the insulator; and a conductive seal member in contact with the front end of the trunk portion of the metal terminal in the axial bore, wherein the insulator includes:

a cylindrical first portion having a first inner diameter, the front end of the trunk portion of the metal terminal disposed therein;

a cylindrical second portion having a second inner diameter larger than the first inner diameter, and including a portion 1 mm or more forward of the rear end of the insulator, and a cylindrical third portion disposed between the first portion and the second portion, and having a rear end and a third inner diameter larger than the first inner diameter and smaller than the second inner diameter; and wherein the trunk portion of the metal terminal includes:

a cylindrical front trunk portion, and a cylindrical rear trunk portion located rearward of the front trunk portion, the cylindrical rear trunk portion having a front end positioned forward of the rear end of the third portion of the insulator, the rear trunk portion having an outer diameter larger than an outer diameter of the front trunk portion.

2. The spark plug according to claim 1, wherein the third portion of the insulator has a thickness in a radial direction equal to or smaller than 6.1 mm.

3. The spark plug according to claim 1, wherein the first inner diameter is equal to or smaller than 2.9 mm.

4. The spark plug according to claim 2, wherein the first inner diameter is equal to or smaller than 2.9 mm.

* * * * *